US008267013B2

(12) United States Patent
Moore

(10) Patent No.: US 8,267,013 B2
(45) **Date of Patent: *Sep. 18, 2012**

(54) BREACHING APPARATUS FOR USE WITH EXPLOSIVE CHARGES

(75) Inventor: Gerald E. Moore, Cloverdale, CA (US)

(73) Assignee: New World Manufacturing, Inc., Cloverdale, CA (US)

( * ) Notice: Subject to any disclaimer, the term of this patent is extended or adjusted under 35 U.S.C. 154(b) by 22 days.

This patent is subject to a terminal disclaimer.

(21) Appl. No.: 13/088,239

(22) Filed: Apr. 15, 2011

(65) Prior Publication Data

US 2011/0197779 A1 Aug. 18, 2011

Related U.S. Application Data

(63) Continuation-in-part of application No. 12/305,059, filed as application No. PCT/US2007/071883 on Jun. 22, 2007, now Pat. No. 8,215,235.

(60) Provisional application No. 60/807,977, filed on Jul. 21, 2006.

(51) Int. Cl.
*F42D 3/00* (2006.01)

(52) U.S. Cl. ..... 102/331; 102/305

(58) Field of Classification Search ..... 102/331; 62/530; 607/108, 112, 114; 206/3, 317, 206/522; 383/3, 38; 220/4.22, 4.23, 4.27, 220/23.2, 23.4, 23.6, 23.8, 503, 505, 506
See application file for complete search history.

(56) References Cited

U.S. PATENT DOCUMENTS

| | | | | |
|---|---|---|---|---|
| 526,501 | A * | 9/1894 | Plummer | 383/40 |
| 747,634 | A * | 12/1903 | Peterson | 383/38 |
| 3,658,006 | A | 4/1972 | Nistler | |
| 3,801,416 | A * | 4/1974 | Gulbierz | 109/49.5 |
| 4,592,478 | A * | 6/1986 | Laconis | 220/23.83 |
| 4,836,079 | A * | 6/1989 | Barrett | 86/50 |
| 4,856,430 | A | 8/1989 | Gibb et al. | |
| 4,874,093 | A * | 10/1989 | Pharo | 206/522 |
| 4,919,293 | A * | 4/1990 | Buckley | 220/23.2 |
| 6,341,708 | B1 | 1/2002 | Palley et al. | |
| 7,000,545 | B2 | 2/2006 | Sansolo | |
| 2008/0035519 | A1 * | 2/2008 | Swartz et al. | 206/522 |

* cited by examiner

*Primary Examiner* — Gabriel Klein
(74) *Attorney, Agent, or Firm* — Craig M. Stainbrook; Stainbrook & Stainbrook, LLP

(57) ABSTRACT

The present invention is a flexible, fillable and/or inflatable breach bag (aqua ram) with a planar body and at least one fillable water chamber for use in breaching locked or barricaded doors or penetrating surfaces with explosive charges. The breach bag may conform to a variety of shapes, depending on the application. The bag generally includes a generally planar panel of flexible material and at least one water chamber disposed on the material layer with a fluid inlet for the selective introduction of fill material, generally in the field. Additionally, the bags include means to suspend the breach bag against structures to be breached.

11 Claims, 15 Drawing Sheets

FIG. 17
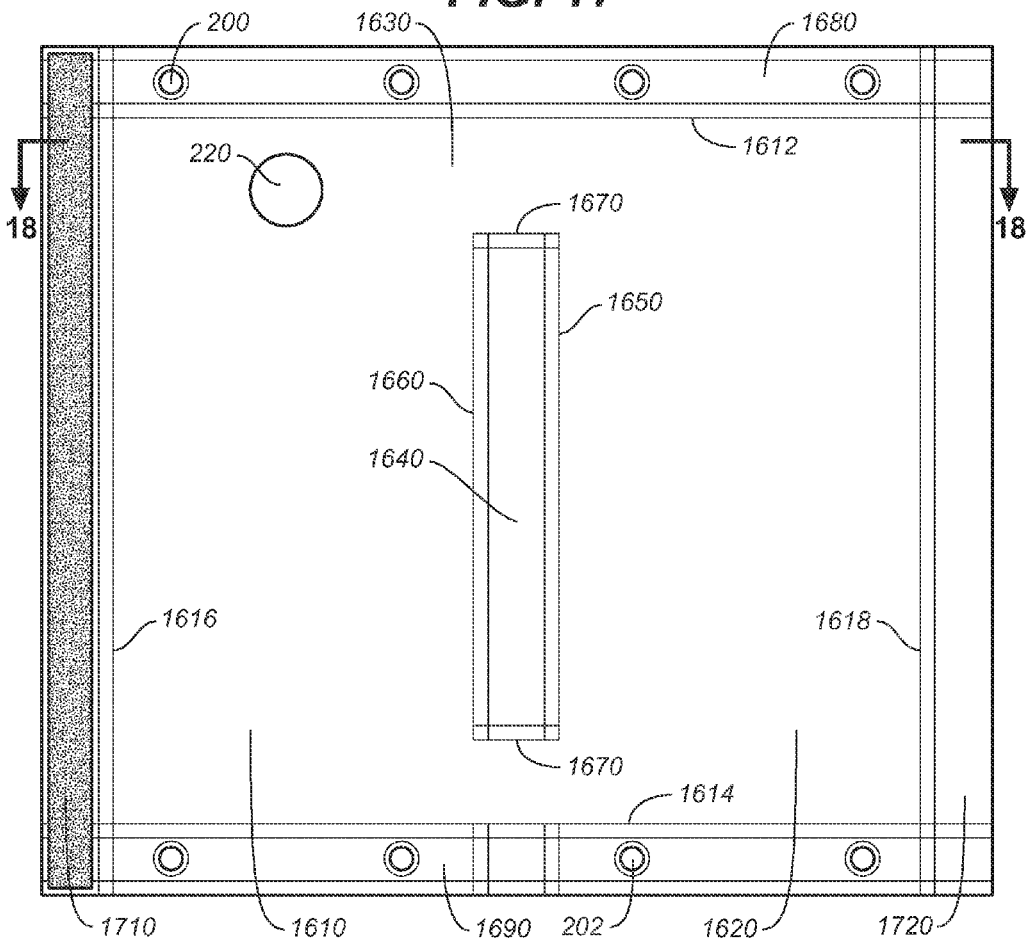
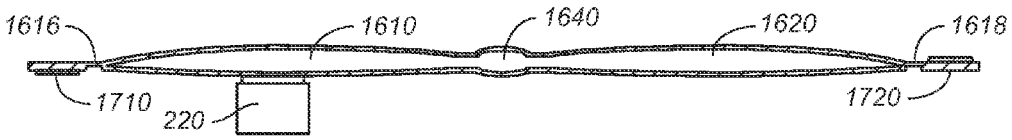
FIG. 18

BREACHING APPARATUS FOR USE WITH EXPLOSIVE CHARGES

CROSS REFERENCES TO RELATED APPLICATIONS

The present application is a continuation-in-part of U.S. Utility patent application Ser. No. 12/305,059, filed Dec. 16, 2008 which is a Section 371 U.S. National Stage application based on International Patent Application Ser. No. PCT/US07/71883, filed Jun. 22, 2007 which claims the benefit of the priority date of U.S. Provisional Patent Application Ser. No. 60/807,977, filed Jul. 21, 2006.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to an apparatus for breaching structures, and more particularly to a flexible, finable, and/or inflatable bag for use with explosive charges for breaching locked or barricaded doors, walls, roofs and ceilings.

2. Discussion of Related Art

Special weapons and tactic (SWAT) teams or other police and military personnel frequently use breaching apparatus to gain entry into locked and barricaded buildings, where criminals, terrorists, hostages, drug caches and the like are located. SWAT teams routinely breach doors quickly by using battering rams, shotguns, and/or explosive charges. These devices can be employed singly or in combination to break the lock or hinges, or even to demolish the door frame itself.

It is known to use explosives to breach doors, but it is challenging to fashion a charge sufficient to blow open a door without causing injury to building occupants and while minimizing damage to property. Explosive charges can be shaped and the blast wave concentrated by reinforcing certain areas surrounding the charge. A shaped charge, by design, focuses its energy into a narrow blast trajectory, making it very accurate and controllable. When size is added to that accuracy, the effect can be dramatic. Shaped charges were first developed after World War I to penetrate tanks and other armored equipment. Their most extensive use today is in the oil and gas industry, where they are used to open rock around drilled wells.

In the case of doors and windows, it is desirable to concentrate a blast wave to impact a region roughly two to three feet in diameter directly on the structure. Additionally, it is important to eliminate potentially injurious back blast. Accordingly, a number of interacting factors must be carefully calculated, including the type, size and focus of the explosive charge, the stand-off distance with which the charge is placed, and the kind (if any) of casing or jacketing to shape, disperse, and direct the blast wave.

In recent years law enforcement agencies have discovered that it is possible to shape a suitable charge through the combination of detonating cord and conventional intravenous bags, plastic soda bottles, or similar containers. To avoid the inconsistencies occasioned by such use, a flexible and/or foldable and easily portable apparatus was designed and has been successfully been employed as a jacketing material for door breach charges. The present invention, hereafter referred to as a "breach bag," is an apparatus that can be adapted to many different situations which necessitate the controlled penetration of a locked entryway, wall or armored surface. Essentially, the breach bag incorporates one or more bladders that can be filled with water (or another non-compressible fluid) or sand or with various metals in various shapes and sizes. By changing the configuration of the breach bag, a directed blast wave or a shaped charge projectile can be provided, the particular blast characteristics depending largely on the bladder configuration and contents. Few prior art references are known, the most notable among them including the following United States patents.

U.S. Pat. No. 3,658,006 to Nistler, et al., describes an explosively actuated egress and ingress device having a case formed of relatively light-weight material with an outer surface, and having a linear-shaped explosive positioned within the case adjacent to the outer surface. The case includes a resilient backing material. A pliable gathering material may also be provided within the case to the rear of the linear-shaped explosive charge. The device is designed to cut large holes.

U.S. Pat. No. 4,856,430 to Gibb, et al., discloses a small and lightweight breaching apparatus that provides sufficient energy to breach a wall. The apparatus consists of a number of panels, each including a material matrix and a linear shaped charge embedded in the matrix. Each end of the charge is located adjacent an edge of the panel. The panels are configured to be assembled edge to edge in an open condition with the linear shaped charges arranged end to end, or face to face in a closed condition, with charges on the inside of the assembly. The apparatus may be collapsed for storage and transport and assembled in its open condition to produce a linear charge of fixed shape.

U.S. Pat. No. 6,341,708 to Palley, et al., describes a blast resistant and blast-directing container assembly for receiving explosive articles and preventing or minimizing damage in the event of an explosion. The container assembly includes an opening covered by a band of blast resistant material with at least one slit in the band and possibly blast mitigating material disposed in the container. The container can be collapsible for storage when empty.

U.S. Pat. No. 7,000,545 to Sansolo, teaches a breaching apparatus including a housing constructed of a material and an explosive charge placed in the housing. When detonated, the housing disintegrates in the explosion without giving off significant material fragments.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention is a flexible and/or foldable container with at least one fillable water chamber which is employed in conjunction with an explosive charge for use in breaching locked or barricaded doors or penetrating surfaces. It is therefore usefully described as a "breach bag." It comprises a planar body and at least one water chamber structure for containing fluid or solid materials. The breach bag can be utilized to focus an explosive shock wave, create a concussive force, or create an explosively formed projectile, depending upon the configuration of the fillable water chamber(s) and the nature of the fill material used to fill the water chamber(s).

In a preferred embodiment of the inventive breach bag, the apparatus utilizes an annular water chamber integrally connected to a planar body material and structure. A capped fill port is used to selectively introduce a non-compressible material such as water into the water chamber. Detonating cord (also known as "detcord", "detonation cord", "detacord," det cord," "primer cord", "primacord", and "cordtex"), sheet explosive, or another explosive charge, is attached to the annular water chamber by adhesives, tape, or other attachment means, and then sandwiched between the water chamber and the structure (wall, roof, door, and the like) to be penetrated. The breach bag is brought into contact with the surface of the structure using a static pole fitted into a boot on the planar body of the breach bag, or alternatively by hanging the breach bag from a line connected to a nail or other structure, such as a plastic shower hook, double-sided adhesive tape, and so forth, located above the breach bag and tied to grommets disposed on the perimeter of the planar body structure of the bag. When the explosive material is detonated, the blast wave is focused into the structure according to the annular shape of the filled water chamber. The result is a ring-shaped breach in the structure corresponding to the shape of the water chamber. In effect, this creates an open port into the structure. Such an opening may function as a man way or urgent ingress into, or egress from, the building, or as a gun port, when such uses are called for.

In another preferred embodiment of the breach bag, the bag has a generally planar body structure in a substantially rectangular shape. At least one rectangular water chamber with at least one capped fill port is defined within the perimeter of the planar body. Grommets are disposed on and about the perimeter of the planar body material. Detonation cord, sheet explosive, or another explosive substance is attached to the water chamber in the manner described above, and the breach bag is then attached to the structure, also in the manner described above. When the explosive material is detonated, the blast wave is partly confined and contained by the mass of the filled water chamber into a relatively small region of high explosive energy, thus providing ample force to blow through a wall, door, roof, or other building structures. This embodiment may also be folded lengthwise and held in that conformation by hook and loop material on the edges of the planar body. This conformation creates an essentially hollow space within which an explosive material may be inserted. Upon detonation with an initiating device to the explosive material used, there is a concussive force shaped, confined, and directed into the building structure by the water chamber.

In yet another embodiment, the breach bag includes two or more water chambers, each with individual capped fill ports. In one such configuration, two water chambers are disposed in a generally parallel orientation along a spine defined by seams that separate the water chambers within the perimeter of the planar material body. The breach bag may thus be folded along the spine and secured in a folded configuration by a hook and loop material disposed on outer seams of the planar material body. This folded configuration creates an essentially hollow sleeve within which explosive material may be inserted. The segregated water chambers may be filled with materials of different densities or compressibility to tailor the blast wave to the circumstances at hand. When the explosive material is detonated, the blast forces the more compressible material away from the less compressible material, creating a plume or a projectile that can penetrate even an armored surface.

Another embodiment of a two-chamber device includes first and second water chambers spaced apart on each side of the mid-line of a generally rectangular planar panel of flexible material. The first water chamber has a depth dimension roughly half that of the second water chamber, the latter provided with a centered rectangular pocket for the disposition of a plastic explosive. When the water chambers are filled and the planar panel folded so as to place the first water chamber atop the second water chamber, the explosive charge is surrounded on all sides by a wall of water having roughly equal width dimensions. Thus, the percussive forces from the explosion are distributed fairly evenly around the breach bag.

From the foregoing it will be readily appreciated that it is a principal object of the present invention to provide a new and improved breach bag for use with explosive charges in breaching locked and/or barricaded doors.

It is another object of the present invention to provide a new and improved flexible and fillable breach bag that is effectively flat, or planar, when not filled with fluid.

A further object or feature of the present invention is to provide a new and improved breach bag that may be selectively filled in one or more segregated water chambers.

It is still another object of the present invention to provide a new and improved breach bag having alternative filling means.

It is yet another object of the present invention to provide a breach bag with two or more fillable water chambers that may be filled with different materials of varying compressibility, and that provides a highly predictable, standardized blast wave when explosive charges are disposed within the bag and detonated.

An even further object of the present invention is to provide a novel breach bag that may be combined and deployed in a serial or linear array with other breach bags to provide an expanded blast wave.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

BRIEF DESCRIPTION OF THE DRAWINGS

The invention will be better understood and objects other than those set forth above will become apparent when consideration is given to the following detailed description thereof. Such description makes reference to the annexed drawings wherein.

of a third embodiment in an elongated rectangle with two water chambers.

Figure 12:
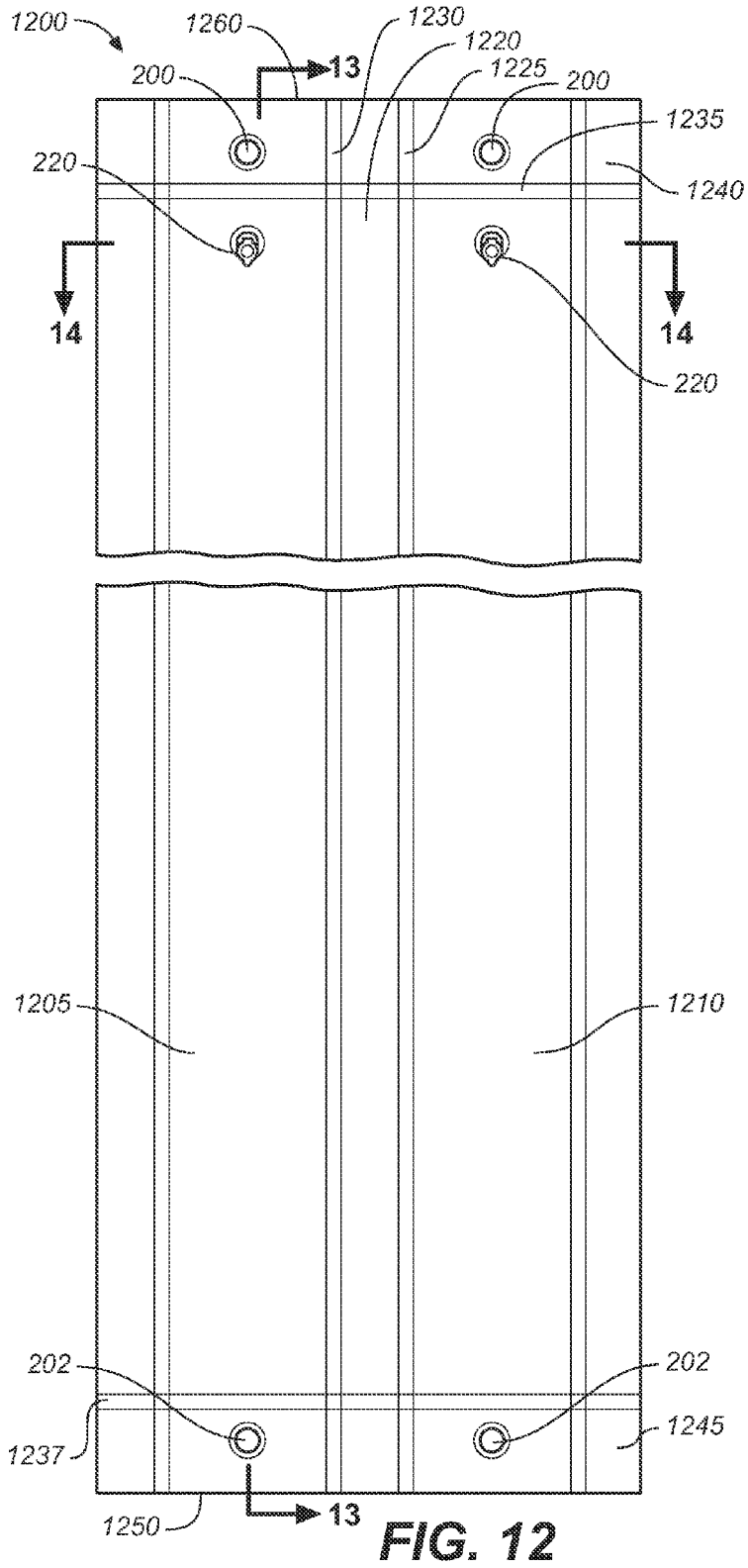

FIG. 12 is front view in elevation of a fourth preferred embodiment of the breach bag, having two water chambers separated by a foldable center seam and shown in an open configuration so as to place the water chambers in a side-by-side orientation.

Figure 14:
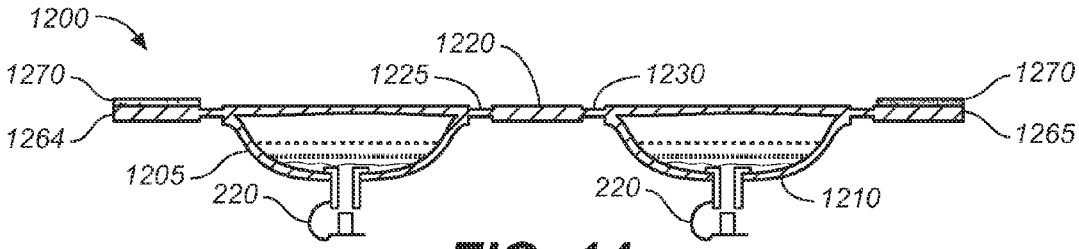
Figure 15:
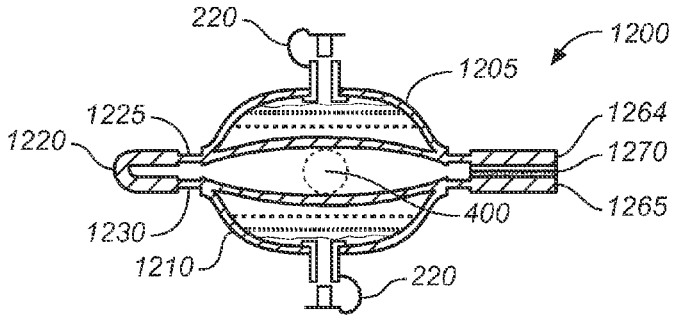
Figure 9:
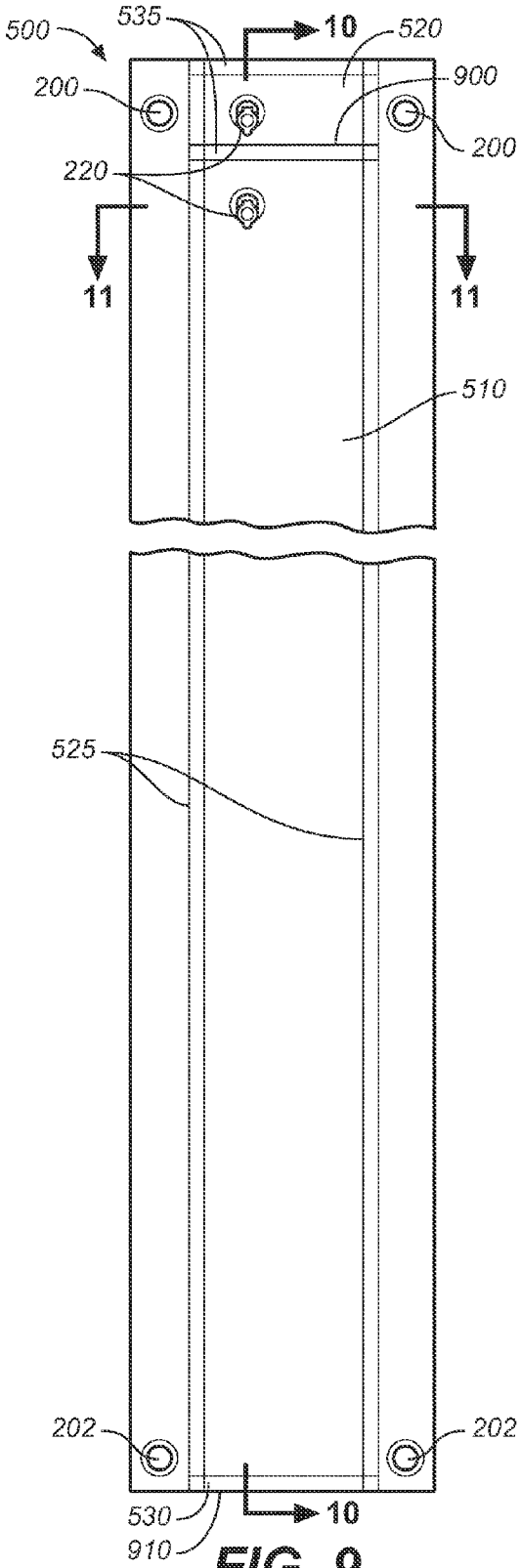
FIG. 9 is a front view of the second preferred embodiment (as shown in FIG. 5), wherein the breach bag includes front and rear water chambers and two longitudinal side seams, each water chamber having a dedicated fill port with a cap, and showing detonating cord is disposed between the front and rear water chambers.
Figure 10:
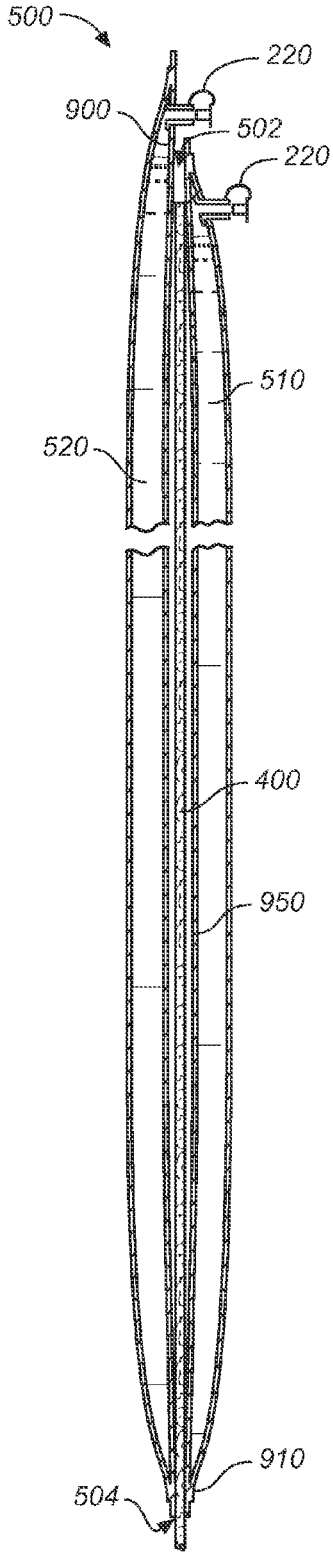
FIG. 10 is a cross sectional side view in elevation thereof, as taken along section line 10-10 of FIG. 5.
Figure 13:
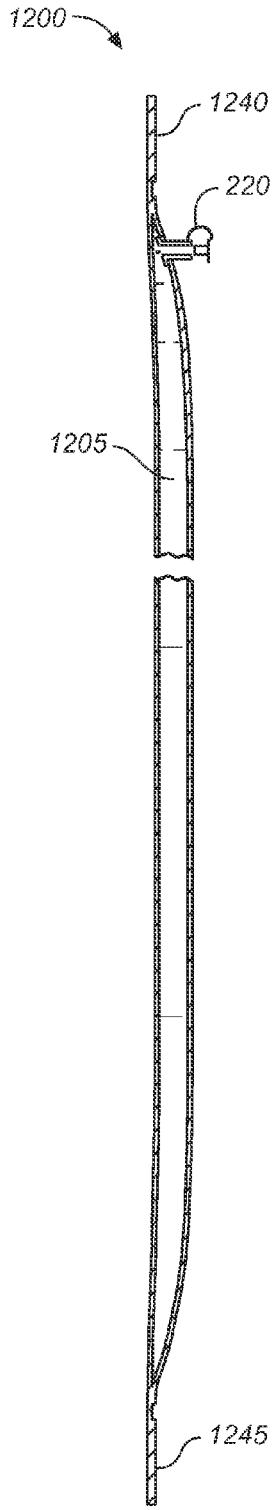
Figure 16:
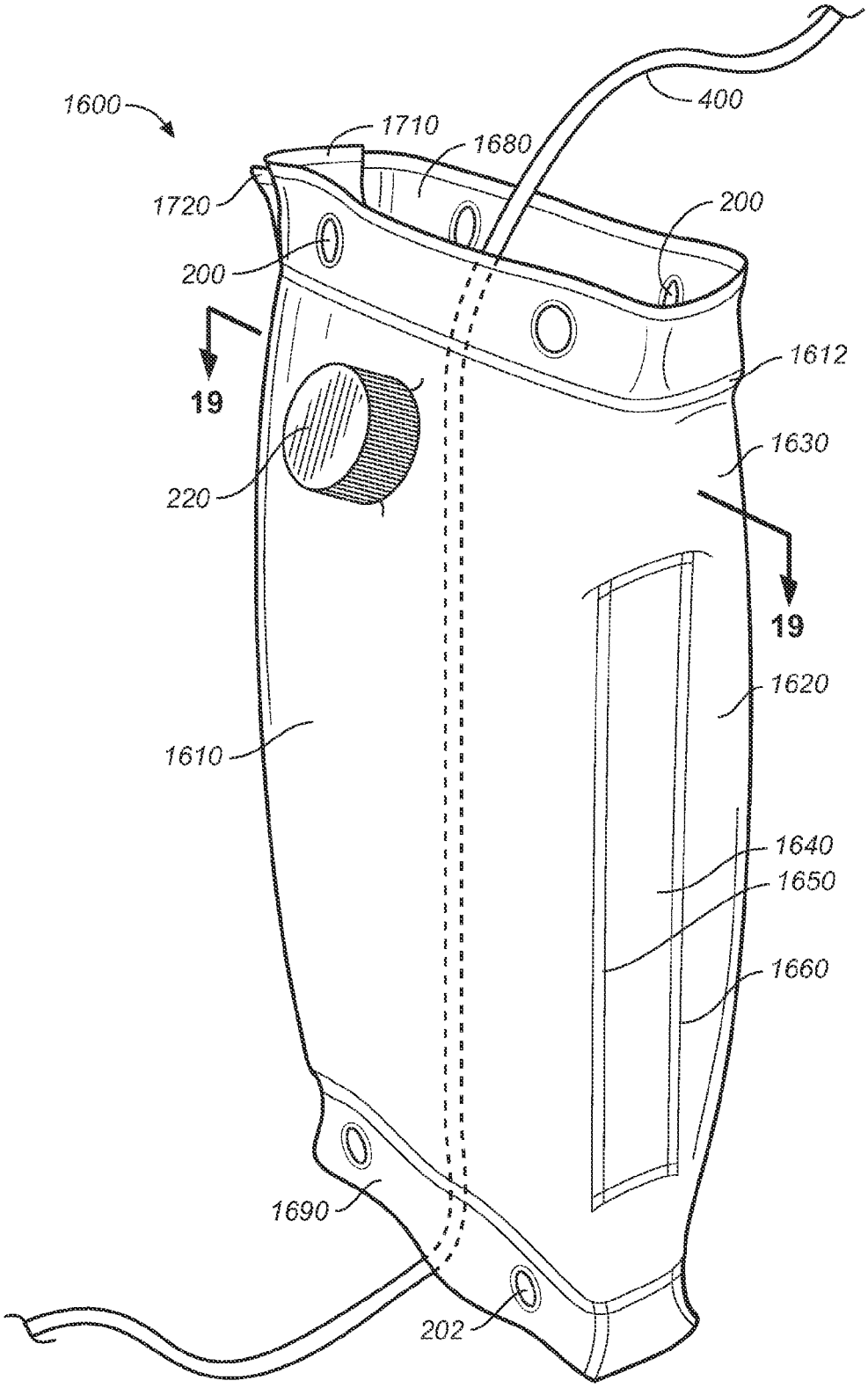
Figure 19:
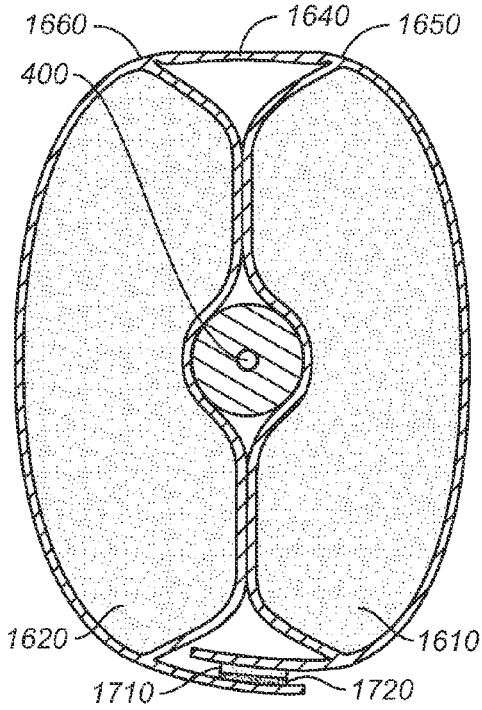
Figure 22:
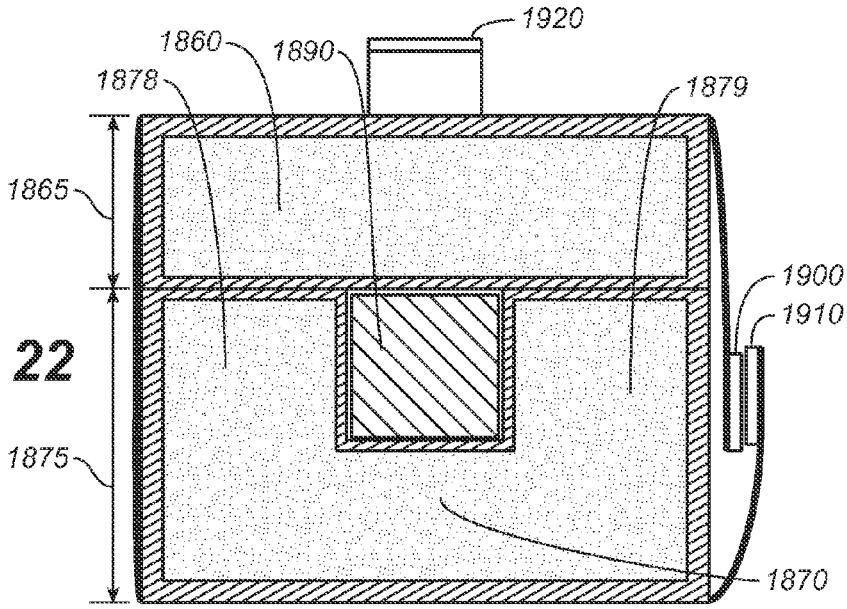
Figure 20:
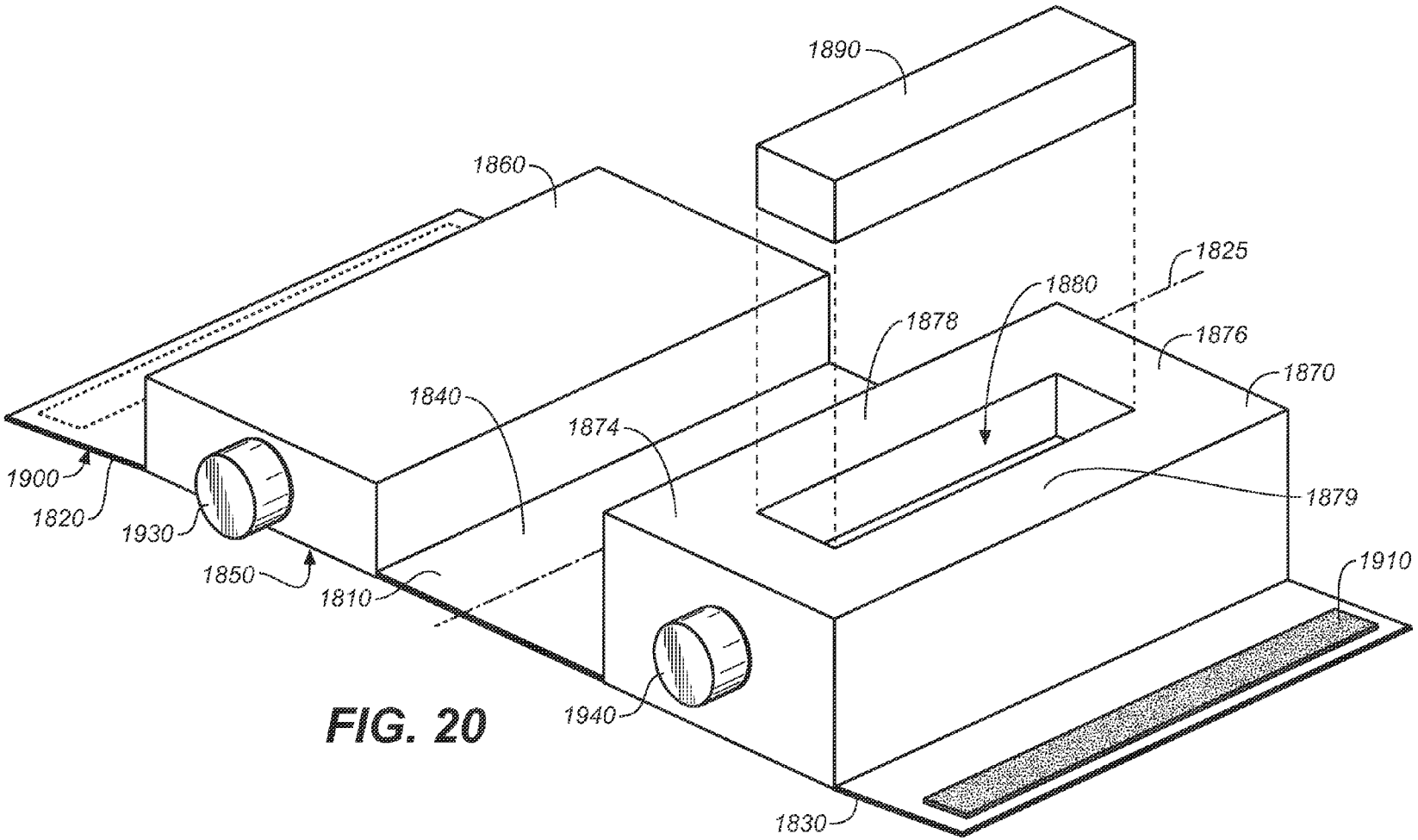
Figure 21:
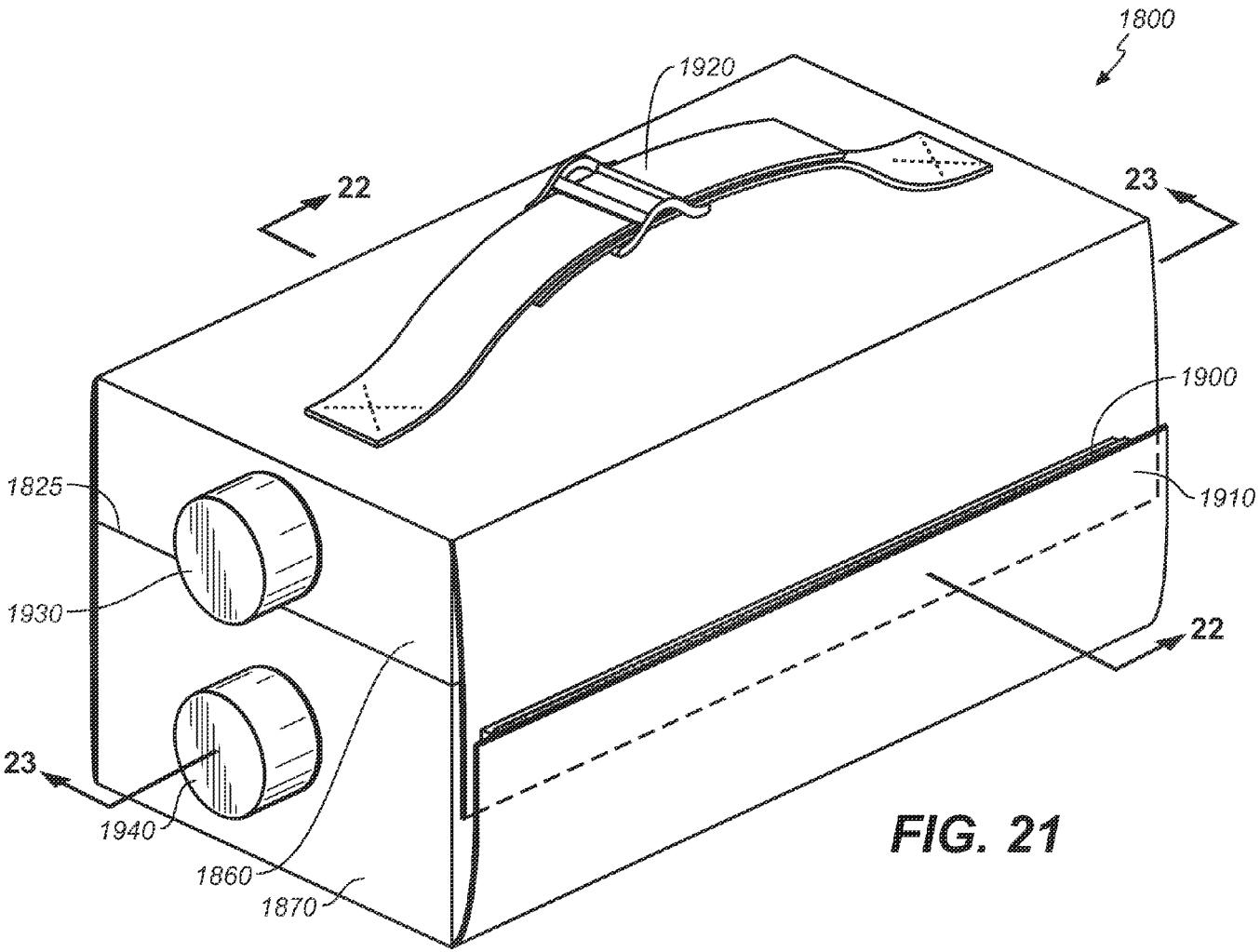
Figure 23:
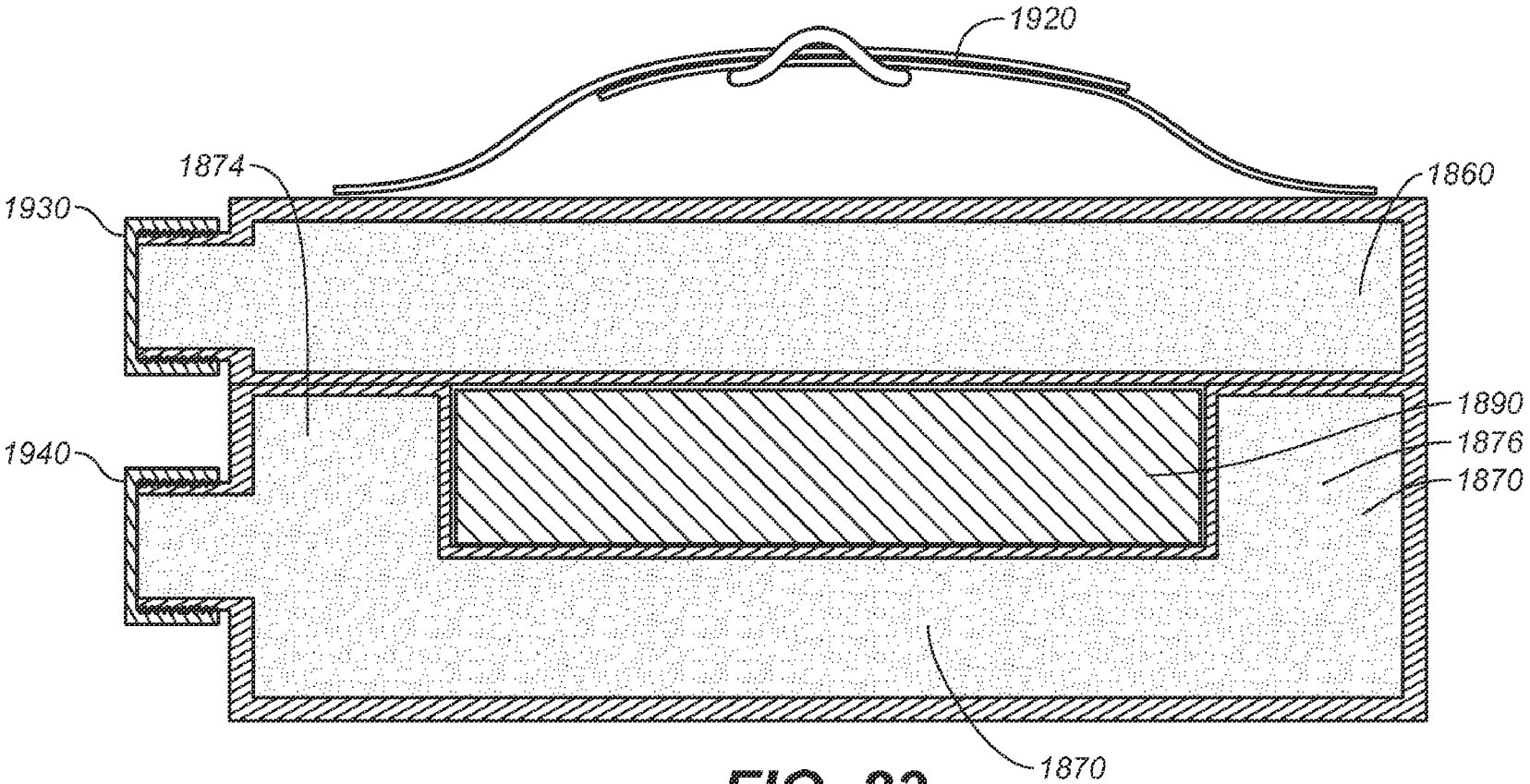

FIG. 13 is cross-sectional side view in elevation thereof;

FIG. 14 is a cross-sectional top view thereof, taken along section line 14-14 of FIG. 12;

FIG. 15 is a cross-sectional top view showing the fourth preferred embodiment in a folded configuration and with detonating cord disposed within the opening formed between the water chambers;

FIG. 16 is a perspective view of a fifth preferred embodiment;

FIG. 17 is a front view in elevation thereof;

FIG. 18 is a cross-sectional top view thereof taken along section line 18-18 of FIG. 17;

FIG. 19 is a cross-sectional top view thereof taken along section lines 19-19 of FIG. 16, showing the bag filled with fill material, and folded and closed around a length of detonating cord;

FIG. 20 is an upper perspective view of a sixth preferred embodiment of the breach bag of the present invention, showing the bag open with the water water chambers partially filled with water and poised for installation of a stick of a C-4 explosive charge;

FIG. 21 shows the bag closed and with both water chambers filled with water;

FIG. 22 is a cross-sectional end view thereof taken along section lines 22-22 of FIG. 21; and FIG. 23 is a cross-sectional side view thereof taken along section lines 23-23 of FIG. 21.

DETAILED DESCRIPTION OF THE INVENTION

Referring first to FIGS. 1 through 19, wherein like reference numerals refer to like components in the various views, there is illustrated a new and improved selectively fillable bag for use with explosives in breaching building structures such as doors, walls, ceilings, roofs, and the like. A first preferred embodiment of the inventive apparatus is generally denominated 100 herein.

Figure 1:
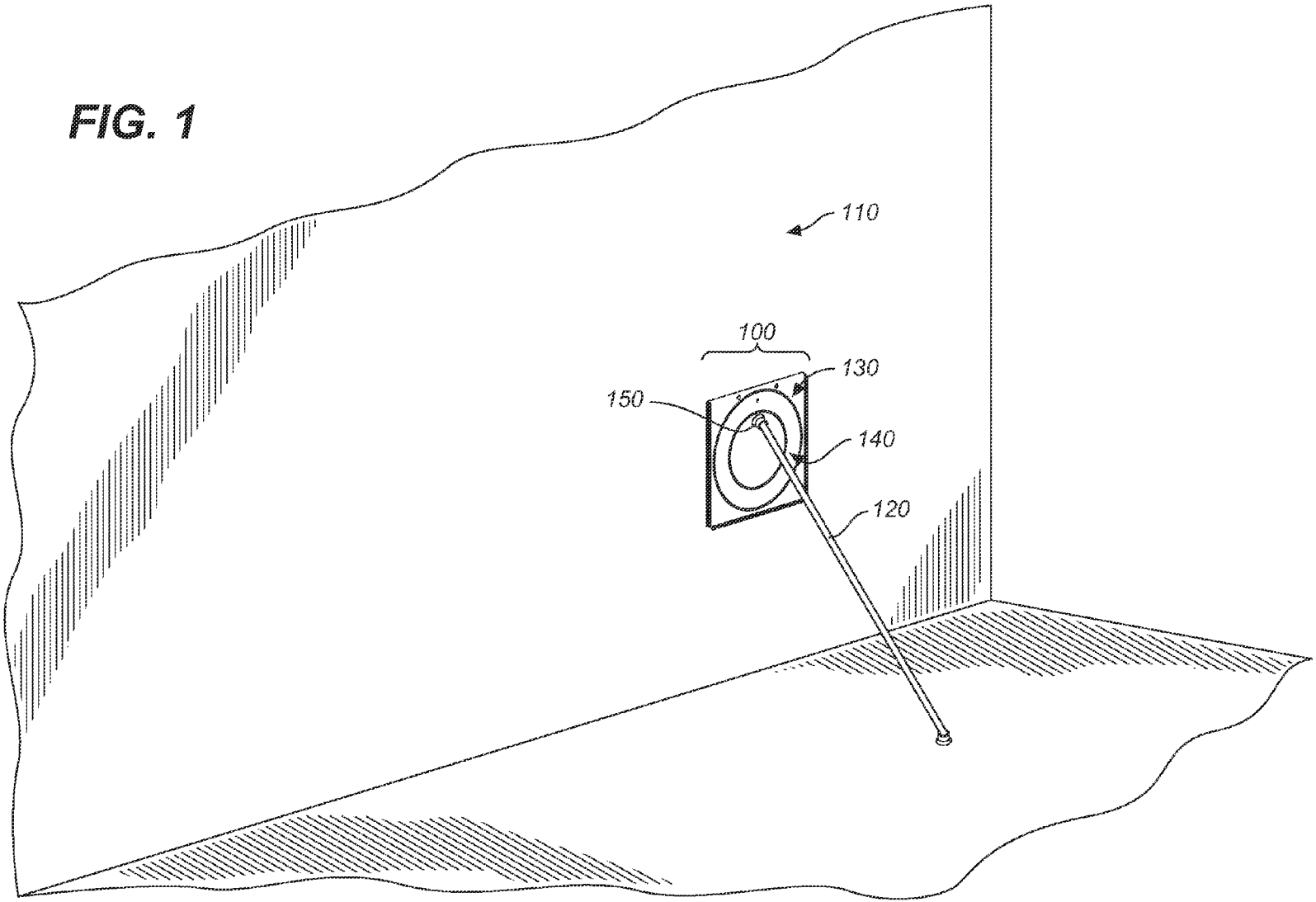
FIG. 1 is a pictorial perspective view illustrating a first preferred embodiment of the breach bag affixed to a wall with a static pole and showing its use in breaching a wall.
Figure 2:
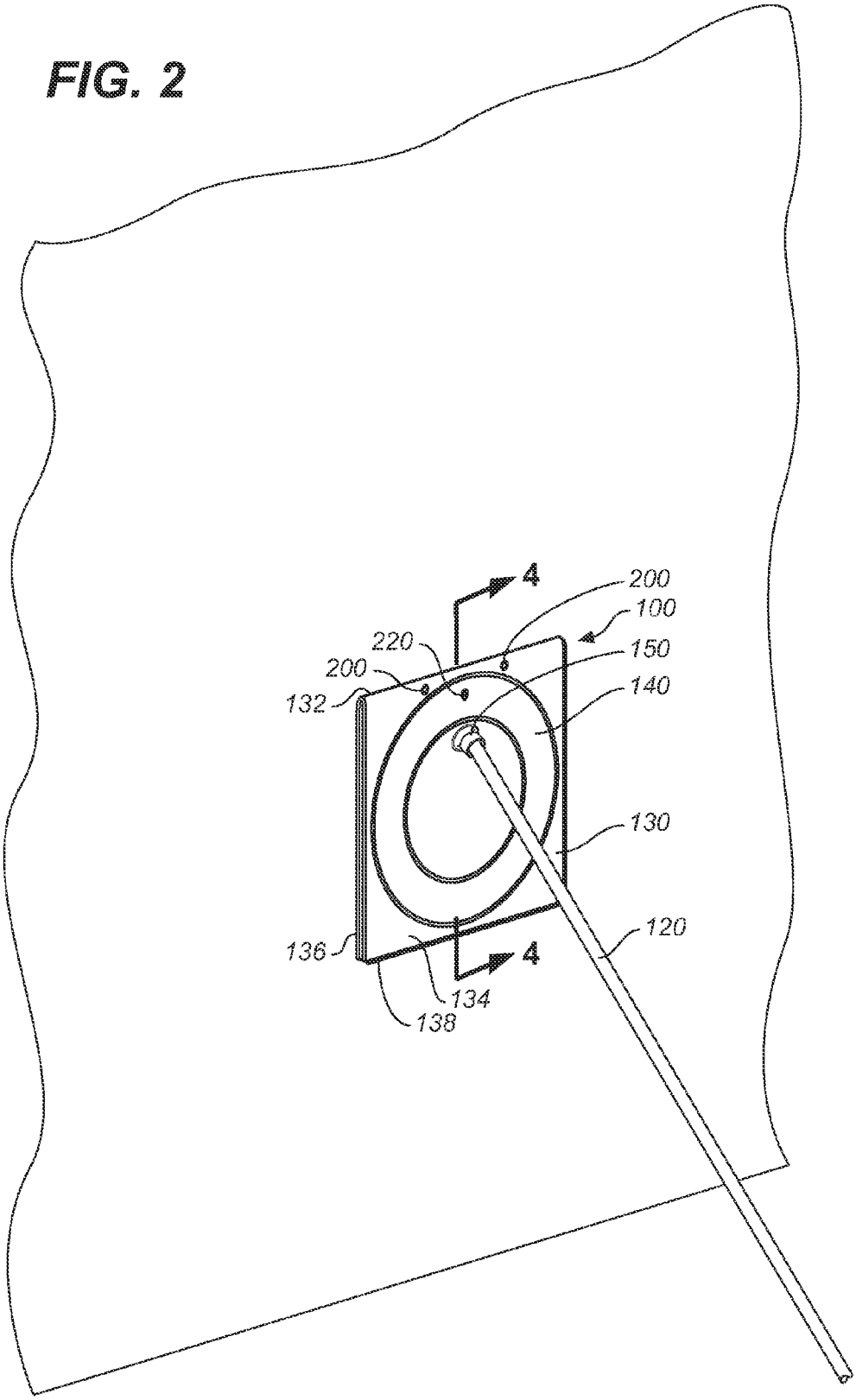
FIG. 2 is a perspective view of a first preferred embodiment shown in FIG. 1.
Figure 3:
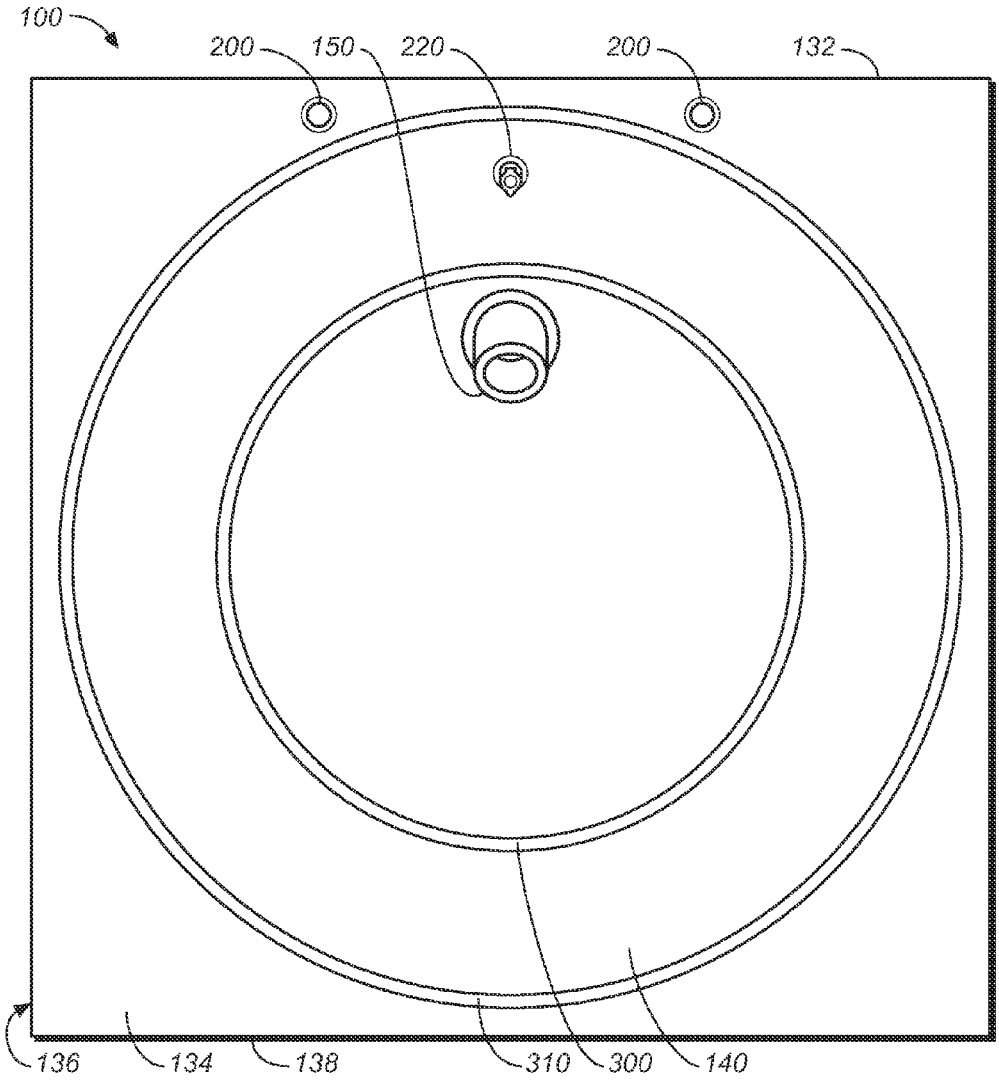
FIG. 3 is a front view of the breach bag shown in FIGS. 1-2.
Figure 4:
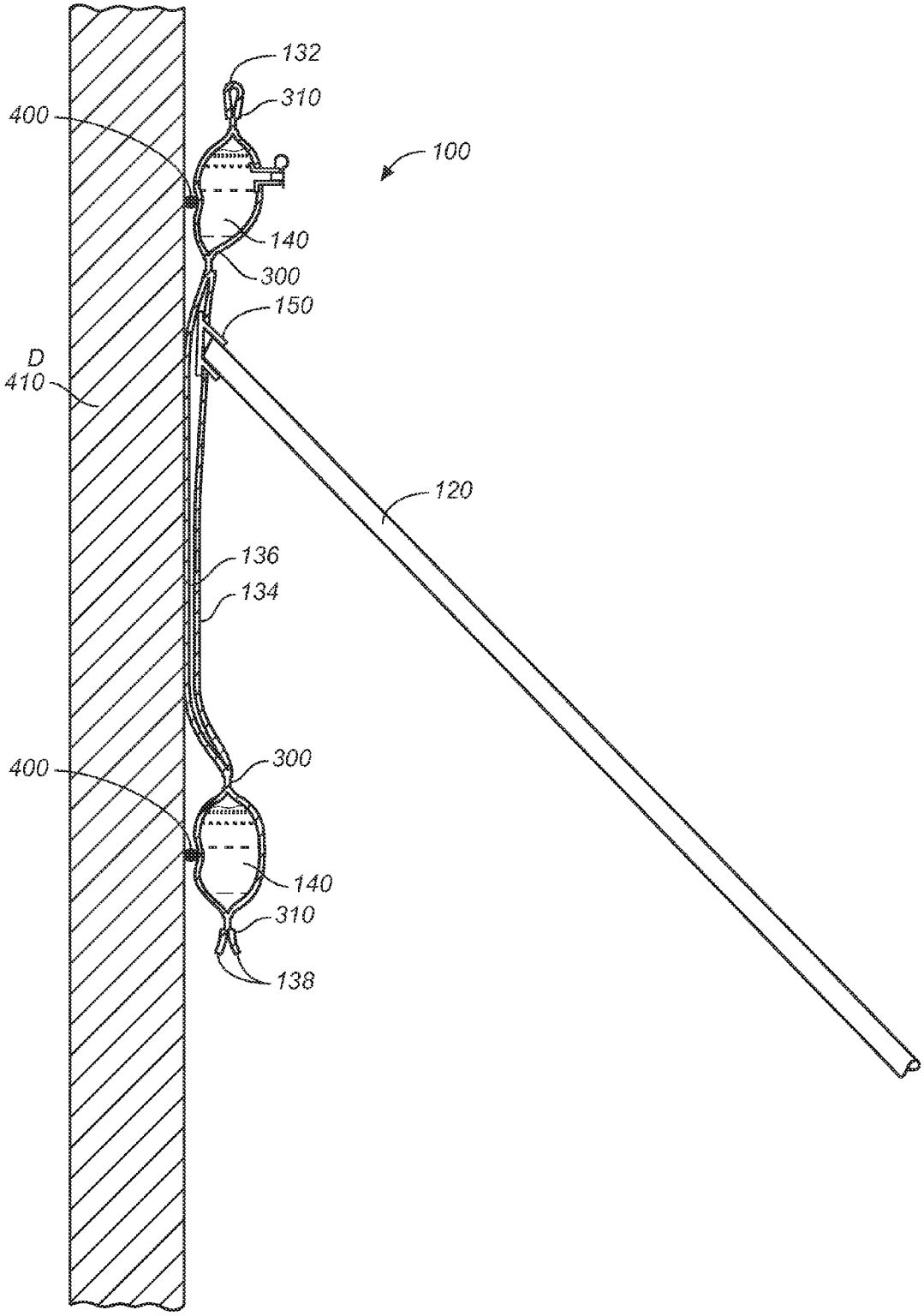
FIG. 4 is a side cross sectional view in elevation of the breach bag and static pole shown in FIGS. 1-3, as taken along section line 4-4 of FIG. 2.

FIGS. 1-4 show that the breach bag 100 can be placed against a wall or door 110 or other generally vertical surface with a static support or positioning pole 120. In this first preferred embodiment, the breach bag 100 includes a unitary, flexible, and substantially rectangular and planar material sheet or panel 130, having a fold 132 generally at a midline of the panel (and shown here as a top edge) so as to form front and back sides, 134, 136, respectively, and a bottom edge, which may comprise free panel ends 138, though the ends may be married with a weld or seam. An annular water chamber 140 is defined in an interior portion of the panel and within the perimeter of the folded panel 130 by concentric, spaced apart inner and outer seams 300, 310, or material welds, which join the front and back sides of the material sheet to form a closed ring having a void suitable for filling with a selected fill material. The annular water chamber surrounds a substantially circular, interior planar portion of material that is not in fluid communication with the annular water chamber. While the interior planar portion of material comprises two layers of material sheets that could be employed as a second water chamber, in the first preferred embodiment, the annular ring is exclusively employed for the introduction of fill material for use as tamp or water percussion control of a blast. In most instances the substance used to fill the water chamber will be water, as it is readily available, may be dispensed through nozzles suitable for the easy and rapid introduction of the water into the water chamber, and because it is non-flammable and non-toxic. However, the use of numerous other materials is contemplated in order to tailor blast characteristics to the needs at hand. Such alternative fill materials may include sand, other particulate material of small size, such as metal pellets, or solid larger diameter materials, For use in a wall or door breaching application, such as depicted in FIGS. 1, 2, and 4, the static support or positioning pole 120 is inserted into a pole boot 150 located in the upper portion of the interior planar portion 130 of the material panel as defined by the inner circumference of the annular water chamber 140. A pole foot 125 may be employed to secure the positioning pole. Detonating cord 400, or primer cord as it is sometimes called, or another selected explosive material such as C2 or C4, is placed onto the annular water chamber 140, typically at the apex or outermost point on the bulging surface of the annular water chamber, the bulging being created by the volume of fill material within the annular water chamber. The detonating cord is affixed to the annular water chamber surface with an adhesive, such as tape, and when the breach bag is propped up against the building structure, the detonating cord is interposed between the breach bag and the target surface, in this instance a wall 410. Rapid, nearly instantaneous detonation of the explosive can be achieved with an initiating device, such as a switched electric current or by triggering a primer or other blasting cap operatively connected to an exposed end of the detonating cord. The mass and relative incompressibility of the fill material within the annular water chamber 140 directs the blast wave through the surface to be penetrated, creating a hole suitable for a manhole or gun port.

The preferred material for the planar panel from which the breach bag of the first preferred embodiment is made is 30 mil PVC plastic. Various weights, densities, and material thicknesses may be employed according to the intended use.

FIGS. 2 and 3 show that the top edge of the planar panel 130 includes one or more grommets 200 used as an alternative attachment means for securing the breach bag against a structure. The grommets allow the bag to be hung with line tied to a nail or other secure structure above the breach bag. So disposed, the bag effectively hangs against a vertical wall or door.

Figure 5:
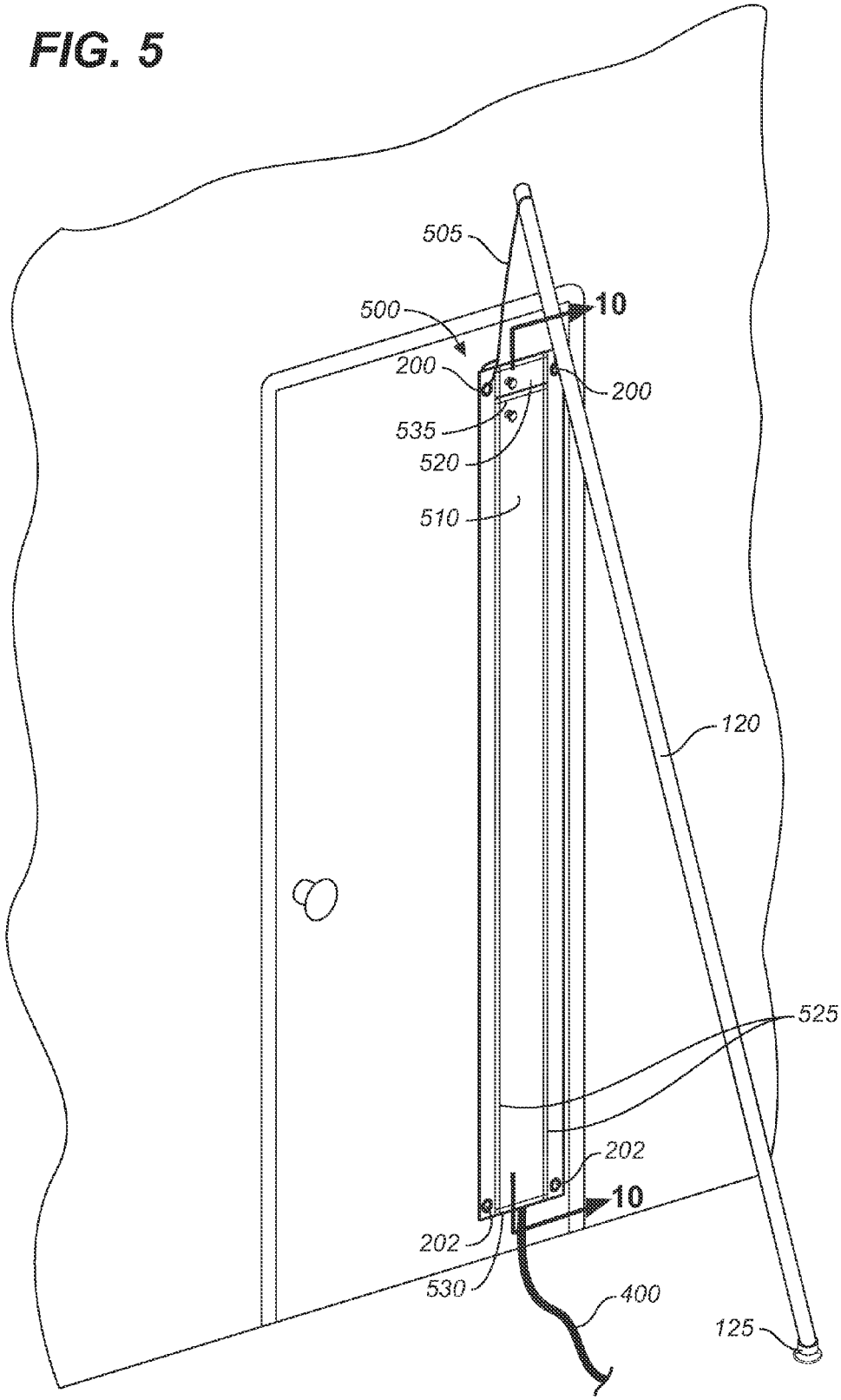
FIG. 5 is a perspective view of a second preferred embodiment of the breach bag of the present invention, an elongated rectangular configuration, and showing it hung in proximity to door hinges.

FIGS. 5, 9-10, and 11, collectively show a second preferred embodiment 500 of the breach bag configured as an elongate rectangle. FIG. 5 shows this embodiment deployed proximate door hinges by stringing a line 505 through one or more grommets 200 and hanging it on a static positioning pole 120, or other structure suitable for holding the weight of the water-filled apparatus. Alternatively, the bag can be secured against a wall or door with a strong and instantly effective adhesive, such as the glues employed in rodent glue traps and trays. In this embodiment, the inventive apparatus is a four-ply elongate sleeve having a top opening 502 at the bag top 900 and a bottom opening 504 at the bag bottom 910 and a tube portion 950 running therebetween so as to form a hollow sleeve into which detonating cord 400 may be inserted. The sleeve is defined by two segregated water chambers, including a front water chamber 510 and a rear water chamber 520, each having a dedicated capped fill port 220. The segregated water chambers are defined by seams, preferably comprising RF welded portions of the bag panel material, including substantially parallel first and second side seams 525, which are shared by the water chambers, and substantially parallel front and back bottom seams 530 and front and back top seams 535, respectively, which completely seal and segregate the front and rear water chambers from one another. As can be seen, the fluid inlets are disposed on the same (front) side of the bag, with the rear port being elevated relative to the front port. When the water chambers are filled, they are effectively "inflated" and bulge outwardly so as to generally approximate the interior sides of the water chambers; i.e., to bring them into sufficiently close proximity to enable a length of detonation cord 400 to be captured between the chambers and within the sleeve formed by the folded device, and having a segment of the shock cord exposed outside the bag for detonation. As will be readily appreciated, different fill materials having different densities or compressive properties may be introduced into the respective water chambers, thus tailoring the blast wave to the demands of the situation.

Figure 6:
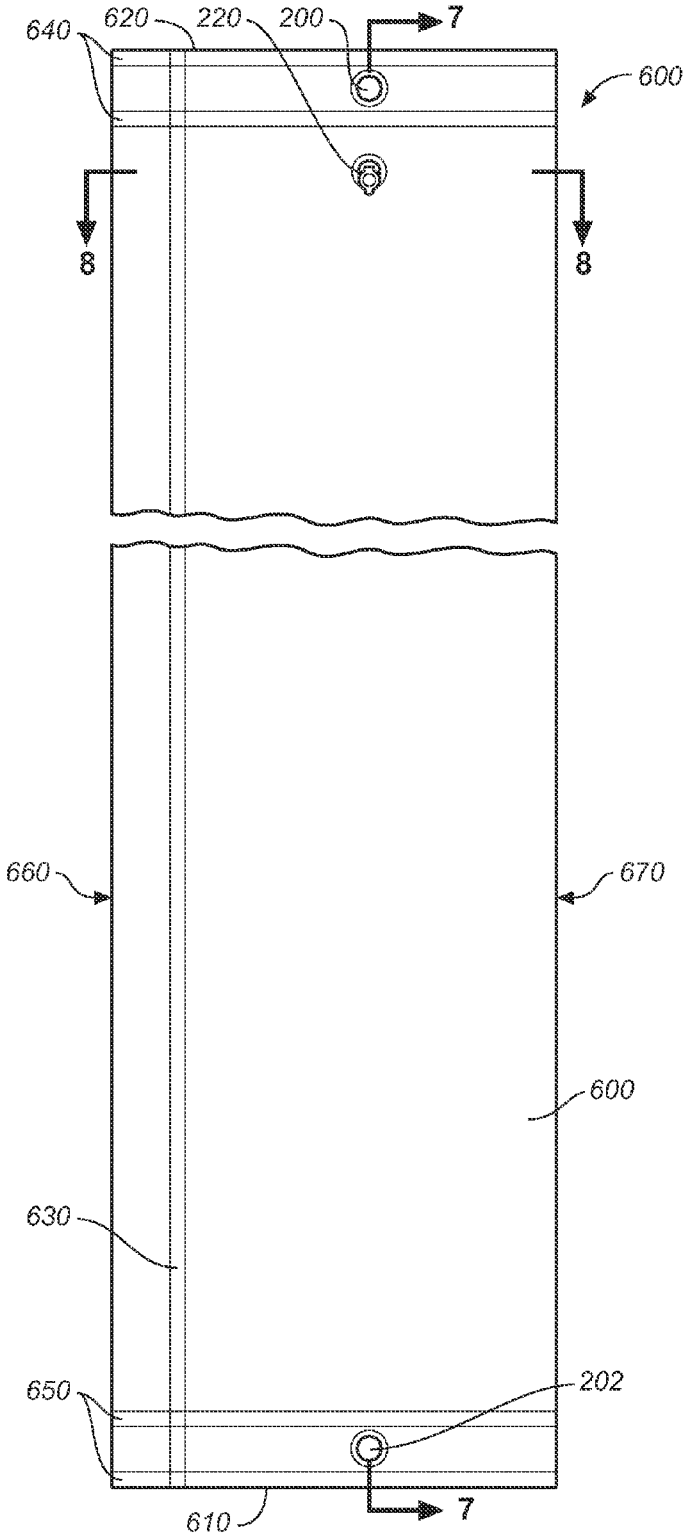
FIG. 6 is a front view in elevation of a third preferred embodiment of the inventive breach bag, showing an elongated rectangular configuration having a single contiguous water chamber folded to form a hollow sleeve with a single longitudinal seam.
Figure 7:
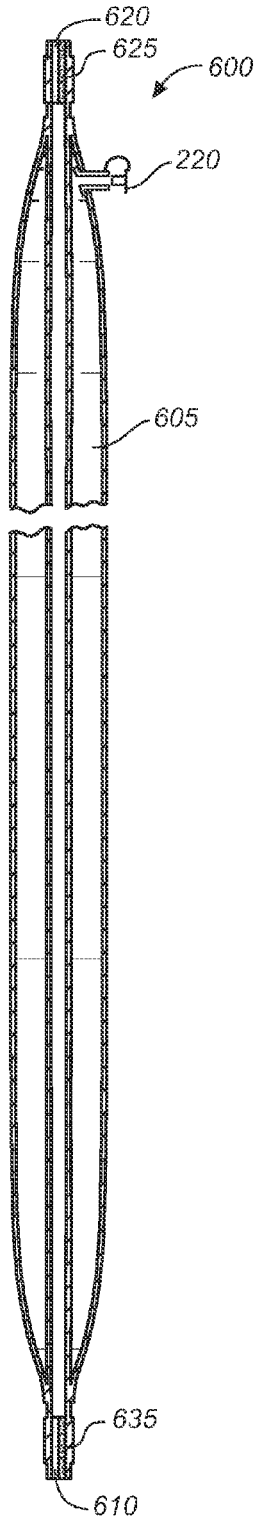
FIG. 7 is a cross sectional side view in elevation thereof, taken along section line 7-7 of FIG. 6
Figure 8:
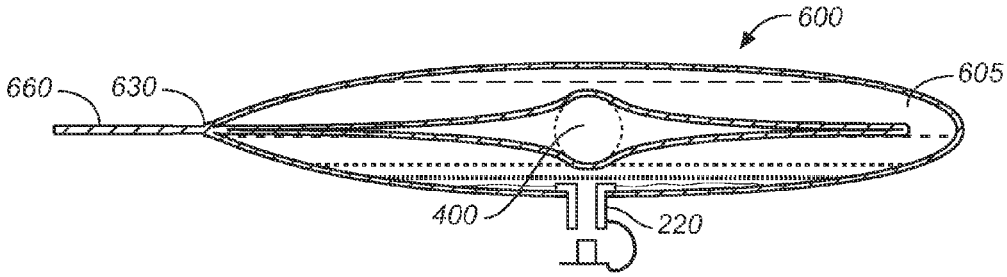
FIG. 8 is a cross-section top view thereof, showing detonating cord (in phantom) disposed within the hollow sleeve, this view taken along section line 8-8 of FIG. 6.
Figure 11:
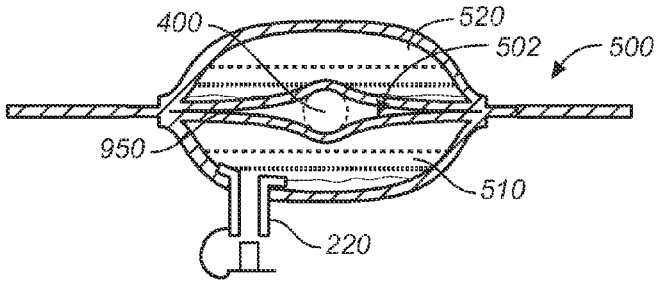
FIG. 11 is a cross sectional top view thereof, taken along section line 11-11 of FIG. 9.

Referring next to FIGS. 6-8, there is shown a third preferred embodiment 600 of the inventive breach bag. In this embodiment, also shown in an elongate rectangular configuration, the bag includes a single and continuous water chamber 605. As will be readily appreciated, the shape of the bag can be altered significantly without altering or eliminating any of the novel features and structural characteristics of the apparatus. Thus, the shape may be square, slightly rectangular, or substantially elongate, depending, again, on the intended use. (Indeed, such a design variation is shown in FIGS. 16-19.) In this third embodiment, the breach bag water chamber 605 is filled with a desired volume of water through the fluid inlet or capped fill port 220, according to the force, shape, and size of the desired blast wave. The water chamber 605 is defined by welds or seams, shown here as a single side seam 630, top seams 640, and bottom seams 650. The top and bottom seams are shown here each as comprising spaced-apart and generally parallel "double" seams so as to define flat portion through which a plurality of upper grommets 200 and lower grommets 202 may be disposed. The grommets serve as attachment points for rope, string or nails to affix the breach bag to a surface. The breach bag is folded on itself at a fold 670 so as to form front and rear water chamber portions and a generally hollow tube or sleeve with a seam edge 660 outside of the single side seam 630. The bag includes openings at the top and bottom ends 610 and 620. Hook and loop material 625, 635 may be disposed on opposing interior sides proximate the respective top and bottom ends and between the top and bottom double seams so as to provide means to create a partial closure at the ends 610 and 620. When the water chamber is filled, it bulges to bring the interior side of the panel into general approximation and to provide force sufficient to capture and retain a length of detonating cord 400.

FIGS. 12-15 show a fourth preferred embodiment 1200 of the breach bag of the present invention. In this embodiment, the breach bag includes a first water chamber 1205 and second water chamber 1210. Each water chamber has an individual re-sealable fluid inlet or capped fill port 220 A medial spine portion 1220 is defined by spine seams 1225 and 1230 running longitudinally substantially or entirely the length of the bag. The water chambers are defined by the spine seams as well as an upper seam 1235 and a lower seam 1237, the latter spaced slightly from the edge of bag material so as to form integral strips. The medial spine portion 1220 does not include a water chamber space for filling with fluid and thus provides an easily foldable linear border for folding the panel material. Upper integral strip 1240 and lower integral strip 1245, each include a plurality of grommets 200, 202, for tying lines when deploying the bag. A first fastening edge 1250 and a second fastening edge 1260, preferably include complementary hook and loop fastener material or other closure means and may therefore be approximated to close the breach bag on itself to create an essentially hollow tube between first water chamber 1200 and second water chamber 1210 within which an explosive charge such as sheet explosive, primer cord, or C4, may be inserted to create the explosive force. The left terminal edge 1264 and right terminal edge 1265 also utilize hook and loop fastener material system 1270 to provide means to close the bag in a stable folded configuration.

FIGS. 16-19, illustrates a fifth preferred embodiment of the present invention. FIGS. 16 and 19 show this embodiment filled, folded and closed to capture and retain a length of detonating cord, while FIGS. 17 and 18 show the bag emptied and in an open, generally planar configuration. This embodiment includes first and second water chambers 1610, 1620, defined by top seam 1612, bottom seam 1614, a first side seam 1616, and a second seam 1618. The water chambers are in fluid communication with one another through a hollow passageway 1630. A spine portion 1640 defined by side spine seams 1650, 1660, and upper and lower spine seams 1670, which do not include a hollow for filling with fluid, provides partial separation of the water chambers and an easily foldable portion of material. The top and bottom seams are spaced apart from the upper and lower water chamber edges to create flat upper and lower integral strips 1680, 1690, each having a plurality of grommets 200, 202, respectively, for tying lines for deployment. The sides of the bag include first and second fastening edges 1710, 1720, which preferably include hook and loop fastener material or other closure means, and which may therefore be approximated to close the breach bag on itself to form a closed sleeve with a through hole for insertion of an explosive charge. As with all embodiments, the bag is provided with a fluid inlet and cap 220, for the introduction of water or other fluids. In a simple alternative to the fifth preferred embodiment, upper spine seam 1670 may be removed so that spine 1640 is in fluid communication with passageway 1630, such that it, too, may be filled with water concurrently with the filling of water chambers 1610, 1620. The open and fillable portion of spine 1640 can be seen in FIG. 18.

As with the earlier described embodiments, the fifth preferred embodiment of the inventive breach bag may be deployed on vertical or horizontal building structures, while it is especially well suited for use in breaching a door. This is accomplished by filling the breach bag with the desired volume of water, sand, or other material, or a combination of materials, according to the force, shape, and size of the desired blast wave. The bag is then folded on itself to form a generally hollow tube with openings at the upper and lower ends 1680/1690 and a closure at the sides 1710, 1720. When closed in such a fashion, the interior sides of the water-filled water chambers are pushed against one another so as to provide force sufficient to capture and retain a length of detonation cord 400 inserted through the tube. This provides the explosive charge. The bag is then positioned against a door by stringing a line through one or more of the grommets and hanging the filled bag on a hook, nail, or other structure immediately above the door.

As will be clear from the foregoing, the preferred embodiments of the breach bag of the present invention are all fabricated from two panels or layers of flexible material, preferably two discrete thin sheets of PVC or a single sheet folded onto itself to create two layers. 30 mil PVC has been shown to be effective for use in breaching most structures encountered in conventional law enforcement. However, material choice and thickness is a matter of design choice. When panels of PVC or other RF excitable thermoplastic materials are used (including various polyurethane materials), seams defining the finable water chambers are created using Radio Frequency welding (also known as RF, Dielectric or High Frequency welding). Similarly, the fluid inlet is installed using RF welding. As is well known, RF welding is a process of fusing materials together by focusing radio frequency energy on the region to be joined, and it creates seams in the present invention that are essentially as strong as the parent material. Other materials that may be employed include polyethylene terephthalate (PET), nylon, and some ABS resins. However, these materials may require special preheated welding bars in addition to RF power. When other, non-RF excitable materials are employed, such as polyethylene, either a hot welding process or adhesives may be employed to create the seams.

Accordingly, fabrication is relatively simple and entails providing a panel of suitable flexible material for the bag. In the case of the first, third, and fifth preferred embodiments, a fluid inlet valve is installed on a portion of the panel, and the panel is cut or folded to create front and back layers of substantially the same size. When RF welding is employed, the layers are placed onto a planar bed plate, where die tooling in an RF welding system is brought into close proximity with the material in a pattern of the seams to be created. The welds are rapidly completed and excess material is removed from any perimeter seams where welding was effected.

Referring now to FIGS. 6-8, in the third preferred embodiment, after the water chamber is formed by welding, the bag is then folded and the material at the unfolded edge 660 is welded. In the case of the fifth preferred embodiment (FIGS. 16-19), after the water chambers are formed by seam welding, the free ends of the unfolded edges are provided with closure structure 1710, 1720, to provide means for selective closure of the bag around an explosive charge.

In the case of the second preferred embodiment, FIGS. 5 and 9-11, after fluid inlets are installed on the panels, the water chambers are fabricated independently with side seams and top and bottom seams so as to place the two water chambers in a generally a side-by-side configuration. The material region defined by the side seams separating the two water chambers is then employed as a folding portion wherein the bag can be folded so as to place the two water chambers into a front and back orientation and to leave a portion of material on the edge of the bag opposite the folding portion. A weld is then made between the edges of material opposite the fold to form a permanent closure around the hollow tube portion 950.

As with the second preferred embodiment, the fourth preferred embodiment requires the installation of two fluid inlet ports, and fabrication follows along the lines of the second preferred embodiment. However, rather than forming a permanent weld to effect the closure at the unfolded edge, selectively closeable means are disposed on the outside edges 1264, 1265 of the bag so that it can be closed at the option of the user.

FIGS. 20-23 show a sixth preferred embodiment 1800 of the present invention. Because it is particularly well suited for use with any of a number of suitable plastic explosive charges, such as C-4, Semtex, Kauerit, Peno, PE4, Formex P1, Sprengkorper DM12, T-4 Plastico, PWM, Nitrolit, PVV-5A Sprängdeg M/46, Plastrite, and DEMEX, and others. Accordingly, it has been given the proprietary name of "C-4 Water Disrupter." The apparatus comprises a generally planar rectangular panel of flexible fabric 1810 having first and second halves 1820, 1830, respectively, divided by a midline 1825, as well as interior and exterior sides, 1840, 1850, respectively. A first cuboid water chamber 1860 is generally centered on the interior side on the first half of the panel, and a second cuboid water chamber 1870 is generally centered on the interior side on the second half of the panel. The longest (length) dimension of each water chamber is substantially commensurate with the width of the panel, while the width is shorter than half the length of the panel, and the depth is determined such that when positioned generally centered on a half of the panel, the two water chambers are spaced apart so as to provide ample room for the panel to be folded and the water chambers brought into a generally stacked relationship when filled with fluid fill material.

It will also be seen that one of the first and second water chambers is configured with an integral pocket or recess 1880 shaped to accept a shaped plastic explosive charge 1890. The interior and exterior sides also include closure elements means for closing the bag around the water chamber, in this instance the elements comprising complementary elongate hook and loop fastener strips 1900, 1910 disposed lengthwise proximate the edges of the fabric panel. Such a closure is shown in FIG. 21, which also shows that the bag includes a strap or handle 1920 for carrying the package when prepared for use. It will be seen by reference to FIG. 21, when prepared for deployment, the caps 1930, 1940 of the first and second water chambers are generally in vertical alignment and the apparatus is generally cuboid in shape. Filled with water and bearing an explosive charge, the bag designed for breaching operations typically weighs 19-20 pounds. If intended for use as an aqua ram for breaching a door or wall in a structure, the bag may be provided with grommets, rings, or other elements for securing the bag to the structure with a fastener, tie strap, carabiner or other ring, and the like.

The operation of filling the bag properly is critical to its effectiveness. Care is therefore taken to ensure even filling of the water chambers and proper alignment of the panel closure when preparing the apparatus for use. As a first step in preparing the breach bag, the explosive charge is placed in the pocket or recess 1880 in second water chamber 1870. The breach bag is then stood on end with the end closures oriented vertically and the caps 1930, 1940 removed from the water chamber closures. The water chambers are then partially filled with water, perhaps slightly less than half full, and the chambers are recapped. The breach bag is then laid back onto a side with the first water chamber under the second and the caps in a generally vertical orientation. The closure strips are brought into close alignment along their entire lengths and then approximated to effect a closure. The breach bag is then once again stood on end with the caps in the uppermost position. The caps are removed and the water chambers alternately filled in stages until each chamber is full. The caps are replaced and the breach bag is then ready for deployment.

Referring particularly to FIGS. 20, 22 and 23, it will be seen that the first water chamber has approximately one-half the depth 1865 as the depth 1875 of the second water chamber. Furthermore, pocket 1880 is generally centered in the second water pocket and sized such that the thickness of the water barrier (the volume of each water chamber) on each side of the pocket is substantially the same. When the breach bag is filled and properly folded, the pocket is covered by the first water chamber, which has a depth or thickness 1865 approximately the same as the depth of the water chamber below 1872 the pocket 1872, as well as the thickness of the water barrier surrounding the pocket on the top side 1874, the bottom side 1876, the inside side 1878, and the outside side 1879 sides. This configuration is such that when an explosive charge 1890 is placed in pocket 1880 and the water chambers are filled and the bag closed, the charge is bounded and surrounded on all sides by essentially equivalent volumes of water. Accordingly, the force of a blast from the contained charge tends to be substantially evenly distributed on all sides of the charge.

In each of the preferred embodiments the breach bag is lightweight, foldable, flexible, compact, easily stored and transported, and rapidly prepared for use in the field. It is ideal, therefore, for military and law enforcement applications. In any of the embodiments with segregated front and back water chambers, the back side of the bag may be filled with fill material, or, alternatively, it may be left empty. When filled the bag functions to create a fluid impulse charge, whereas when left empty, the material tend to confine or "tamp" the explosive charge.

The foregoing disclosure is sufficient to enable those with skill in the relevant art to practice the invention without undue experimentation. The disclosure further provides the best mode of practicing the invention now contemplated by the inventor. It will be appreciated by those skilled in the art that the basic breach bag design may take on a multitude of configurations depending upon the desired application.

While the particular breach bag apparatus and method herein shown and disclosed in detail is fully capable of attaining the objects and providing the advantages stated herein, it is to be understood that it is merely illustrative of the presently preferred embodiment of the invention and that no limitations are intended concerning the detail of construction or design shown other than as defined in the appended claims. Accordingly, the proper scope of the present invention should be determined only by the broadest interpretation of the appended claims so as to encompass obvious modifications as well as all relationships equivalent to those illustrated in the drawings and described in the specification.

What is claimed as invention is:

1. A breach bag for breaching structures, comprising: a panel of flexible material; first and second discrete water chambers integral with or disposed on said panel for the insertion of a fill material, at least one of said water chambers including a pocket with an explosive charge disposed therein; each said water chamber including a selectively closeable fluid inlet; closure elements disposed on opposing sides of said panel such that the panel is securable in a folded closed configuration by fastening said closure elements to one another, said folded closed configuration enclosing the explosive between the first and second water chambers such that the explosive is surrounded on all sides by a layer of fill material when the water chambers are filled with said fill material.

2. The breach bag of claim 1, wherein said panel is rectangular and includes first and second halves, said first water chamber disposed in the center of said second half.

3. The breach bag of claim 2, wherein each of said water chambers has a length dimension commensurate with the width of the panel, a width dimension shorter than half the length of the panel, and a depth such that said first and second water chambers are sufficient spaced apart so as to provide room for the panel to be folded and the closure elements engaged when said first and second water chambers are filled with fluid fill material, in which configuration said first and second water chambers can be placed in a vertically oriented stacked relationship with one another.

4. The breach bag of claim 1, further including a carrying handle.

5. The breach bag of claim 1, wherein each of said first and second water chambers include a fill cap disposed on one side of said panel, such that when said water chambers are filled and said panel is folded and said closure elements are fastened to secure said breach bag in the folded closed configuration, said fill caps are in an aligned vertical orientation.

6. The breach bag of claim 1, wherein said bag includes hanging elements for securing said bag to a structure.

7. A breach bag, comprising: a flexible planar body structure having a front, a back, a top, a bottom, a left side, a right side, and a planar body perimeter; first and second discrete water chambers integral with or disposed on said planar body structure for the insertion of a fill material, at least one of said water chambers including a pocket with an explosive charge disposed therein; each said water chamber including a resealable capped fluid inlet; a plurality of hanging elements incorporated into said planar body perimeter providing means to attach said breach bag to a structure surface; closure elements disposed on opposing sides of said planar body such that the planar body is securable in a folded closed configuration by fastening said closure elements to one another, said folded closed configuration enclosing the explosive between the first and second water chambers such that the explosive is surrounded on all sides by a layer of fill material when the water chambers are filled with said fill material.

8. The breach bag of claim 7, wherein said planar body structure comprises two material layers and each of said water chambers is incorporated into said planar body structure by seams defining respective water chamber perimeters within said planar body perimeter, said seams isolating the interior of each said water chamber from said planar body structure.

9. The breach bag of claim 7, wherein said planar body structure is rectangular in shape.

10. The breach bag of claim 7, wherein said first water chamber has a depth one-half the depth of said second water chamber, and wherein said pocket is centered in the second water chamber and sized such that when said first and second water chambers are filled with water and said breach bag is in the folded closed configuration, the thickness of the water barrier surrounding each side of said pocket is the same, such that the force of a blast from said explosive charge is evenly distributed on all sides of the charge.

11. The breach bag of claim 9, wherein when said water chambers are filled and the breach bag is put into the folded closed configuration, said breach bag is cuboid in shape.

* * * * *